United States Patent [19]

Junger et al.

[11] Patent Number: 4,540,123

[45] Date of Patent: Sep. 10, 1985

[54] ULTRASONIC LIQUID ATOMIZER

[75] Inventors: Martin Junger, Grafenberg, Fed. Rep. of Germany; Karl Floegel, I-Besozzo, Italy

[73] Assignee: Lechler GmbH & Co. KG, Fellbach, Fed. Rep. of Germany

[21] Appl. No.: 531,259

[22] Filed: Sep. 12, 1983

[30] Foreign Application Priority Data

Sep. 13, 1982 [DE] Fed. Rep. of Germany ..... 3233901

[51] Int. Cl.[3] ..... B05B 17/06

[52] U.S. Cl. ..... 239/102

[58] Field of Search ..... 239/4, 102; 310/321, 310/322, 323

[56] References Cited

U.S. PATENT DOCUMENTS 4,301,968 11/1981 Berger et al. ..... 239/102

FOREIGN PATENT DOCUMENTS 2239408 2/1974 Fed. Rep. of Germany ..... 239/102

*Primary Examiner*—Andres Kashnikow

*Attorney, Agent, or Firm*—Shlesinger, Arkwright, Garvey & Fado

[57] ABSTRACT

An ultrasonic liquid atomizer includes a piezoelectric transducer element mechanically coupled to an amplitude transformer and further comprises an atomizing disk mounted at the free end of the amplitude transformer. The atomizing disk and the amplitude transformer are so mutually matched that the vibration system of atomizing disk and amplitude transformer evinces the same resonant frequency as the transducer element, preferably about 60 kHz. Furthermore, the cross-sectional transitions between the transducer element and the amplitude transformer on one hand and between the amplitude transformer and the atomizing disk on the other are designed to be low in notch-stresses. An ultrasonic liquid atomizer so designed evinces both good properties of vibrations and furthermore advantageous long service lives. It makes possible a high specific flow rate and avoids cavitation and therefore spatters.

11 Claims, 1 Drawing Figure

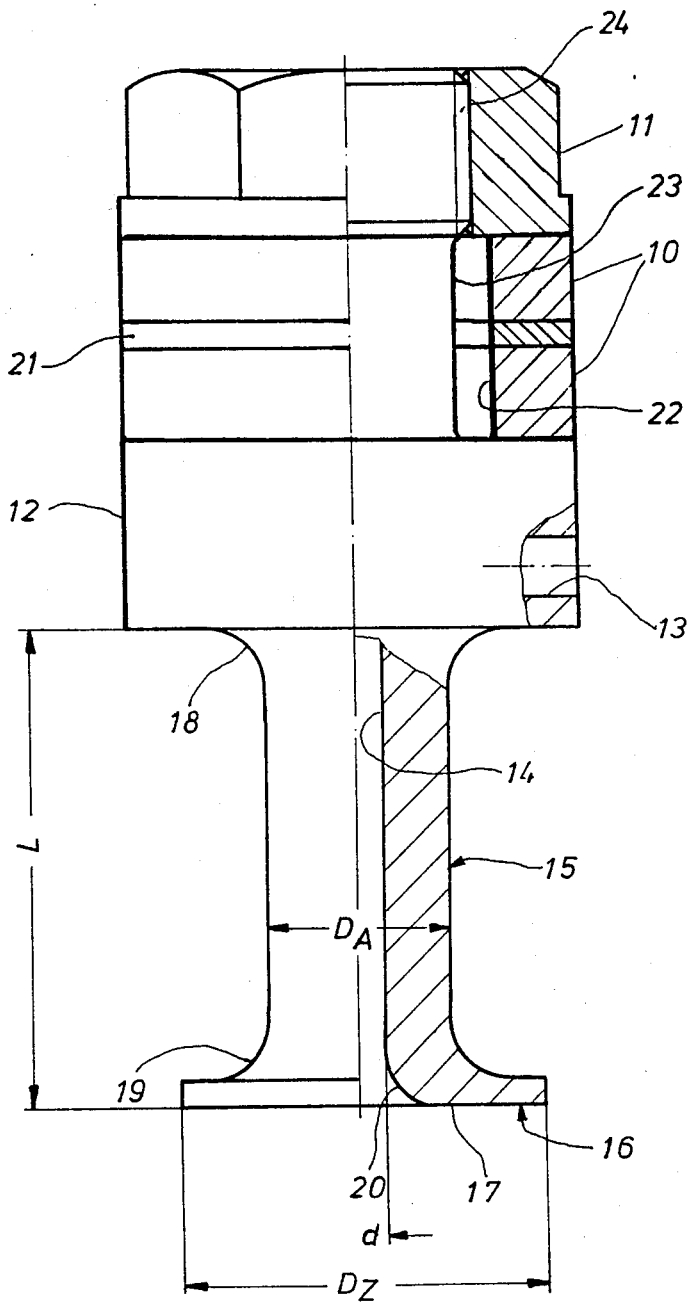
24
11
23
10
21
22
12
13
18
14
L
15
$D_A$
19
16
20
17
d
$D_Z$

ULTRASONIC LIQUID ATOMIZER

BACKGROUND OF THE INVENTION

The invention concerns an ultrasonic liquid atomizer with a piezoelectric transducer element mechanically coupled to an amplitude transformer (also known as "horn" or "blowpipe") and with an atomizing disk mounted to the free end of the amplitude transformer.

Piezoelectric ultrasonic oscillators to atomize liquids are known. The state of the art illustratively includes the periodical TECHNISCHE INFORMATIONEN FUER DIE INDUSTRIE, November 1978, issued by VALCO Co. of Hamburg. Ultrasonic liquid atomizers of the type under discussion consists of a piezoelectric transducer element which in one conventional embodiment is solidly coupled to an amplitude transformer (so-called horn). The transducer element performs the conversion from electrical into mechanical energy, while the "horn" provides amplitude amplification. In order to attain as high an amplitude as possible, the atomizer furthermore must be vibrating near its series resonance.

The U.S. Pat. No. 3,400,892 and the German Pat. Nos. 2,831,553 and 2,137,083 disclose further ultrasonic liquid atomizers of the initially cited kind.

The known ultrasonic liquid atomizers operate with amplitude transformers of which the lengths are at least $\lambda/4$ (for instance the U.S. Pat. No. 3,400,892) up to an integral multiple of $\lambda/4$ (German Pat. Nos. 2,831,553 and 2,137,083). The term $\lambda/4$ here denotes a quarter of the vibration wavelength of the atomizer disk.

Ultrasonic liquid atomizers of the hitherto state of the art have been found unsatisfactory especially regarding the following points.

(a) Their service life is too short due to notch stresses which arise. The problem is a suitable sizing of the ultrasonic liquid atomizer.

(b) The known ultrasonic liquid atomizers evince too low a specific liquid output. The problem is that all of the amplitude transformer is vibrating and that it is not a flexing element with the flexure amplitude increasing outwards. Therefore, comparatively large vibrators were required hitherto.

(c) The known ultrasonic liquid atomizers are characterized by cavitation induced spatters. The large amplitudes of the amplitude transformer in this instance designed as a blowpipe in stages in the region of the liquid feed entail problems. The disadvantageous spatters are caused this way.

In view of the above, ultrasonic liquid atomizers should most of all meet the following requirements:

(1) Their service lives should be long.

(2) High specific liquid flow rates should be possible at low electric power consumption.

(3) There should be freedom from cavitation.

In order to assure as large and versatile a field of application as possible for the ultrasonic liquid atomizer being discussed, the above cited properties should be available not only at room temperature, but also at very high temperatures such as are characteristic for oil burners for instance.

The commercially available known ultrasonic liquid atomizers do not meet the above cited assumptions or only in unsatisfactory manner. While good properties of vibration are present in the known ultrasonic liquid atomizers (see in this respect the initially cited reference), they are manifestly traded off against indisputably short service lives (the occurrence of flexural ruptures). A corresponding state of the art is also discussed in the German Auslegeschrift No. 29 04 861.

It is the object of the present invention to create an ultrasonic liquid atomizer with both good properties of vibration and furthermore the required long service life.

This problem is solved by an ultrasonic liquid atomizer of the initially designated species which is characterized by such matching between the atomizing disk and the amplitude transformer that the vibration system of atomizing disk and amplitude transformer evinces the same resonant frequency as the transducer element, preferably about 60 kHz, and further by the cross-sectional transitions between the transducer element and the amplitude transformer on one hand and between the amplitude transformer and the atomizing disk on the other being designed to be low in notch-stresses.

Accordingly, exceptional results can be achieved when the amplitude transformer, including the atomizing disk, is of a length of at least 1/10 to at most 9/10 of the quarter wavelength ($\lambda/4$) of vibration. Here the relation $\lambda=c/f$ applies, where c is the speed of sound and f is the vibration frequency.

An essential property of the ultrasonic liquid atomizer of the invention is that the atomizing disk flexurally vibrates without one or more circle(s) of nodes, in such a manner that the amplitude of vibration strongly increases toward the rim of the disk while being of a given minimum value at its center. The minimum value of the amplitude of vibration at the center of the disk is determined when the liquid adheres but as yet no atomization takes place. Because of the advantageous properties achieved by the invention, formation of spatters is avoided and nevertheless a good spreading of the liquid over the entire surface of said disk is achieved.

In an advantageous implementation of the basic concept of the invention, the desired low notch-stress design of the vibration system consisting of the amplitude transformer and the atomizing disk is optimally embodied in practice so that the cross-sectional transitions between the transducer element and the amplitude transformer, on one hand, and between the amplitude transformer and the atomizing disk, on the other, evince comparatively large radii, that is, with respect to the diameters of the amplitude transformer and the atomizing disk.

Advantageous further developments of the invention can be found in the dependent claims and also—by means of an illustrative embodiment—in the drawing and the subsequent description of the drawing. The drawing shows an embodiment of an ultrasonic liquid atomizer seen in longitudinal section and in sideview,—each time in half.

A piezoelectric transducer part converting the electrical energy into mechanical energy consists of two ceramic discs 10. An electrode 21 is located between the two ceramic disks 10 of the piezoelectric transducer part and is connected (not shown in the drawing) electrically to the outside. The piezoelectric disks 10 and the electrode 21, are provided with an axial clearance 22 and are seated concentrically on a pin part 23 provided at its upper free end with a thread 24. The pin part 23 widens downwardly stepwise into a transducer element 12 which acts as the lower axial stop means for the two piezoelectric disks 10 and the electrode 21. The piezoelectric disks 10 and the electrode 21 are fixed in place at the upper side by a nut 11 screwed onto the thread 24.

As further shown by the drawing, the transducer element 12 is provided with a lateral connecting bore 13 which feeds the liquid to be atomized into an axial bore 14 within the amplitude transformer 15.

However, the kind of liquid-feed shown in the drawing merely represents an illustrative embodiment. The scope of the present invention furthermore makes possible other ways of feeding the liquid into the central bore 14 of the amplitude transformer 15. For instance, a central liquid-feed is also conceivable.

Again there are the most diverse ways (not individually shown herein) of fastening the ultrasonic liquid atomizer shown in the drawing. Thus it is possible to fix the ultrasonic liquid atomizer by means of a flange to a suitable holding device.

The drawing furthermore makes clear that the amplitude transformer 15 is integrally joined to the parts 12, 23 and 24. The amplitude transformer 15 merges integrally into an atomizing disk 16 at its end. The parts 15, 16 are crossed centrally and axially by the bore 14 already mentioned. The liquid to be atomized is moved onto the surface 17 of the atomizing disk 16, where due to the high-frequency vibrations of the atomizing disk 16, fine atomization of the liquid takes place.

The drawing furthermore shows that the cross-sectional transitions 18 and 19 between the transducer element 12 and the amplitude transformer 15, on one hand, and between the amplitude transformer 15 and the atomizing disk 16, on the other, evince comparatively large radii of 2 mm (transition 18) and 1.5 mm (transition 19).

Because of the large radii of 2.0 and 1.5 mm, respectively, the cross-sectional transitions 18 and 19 are made low in notch-stresses. Accordingly, bending rupture is prevented and long service lives are achieved.

The effective length L shown in the drawing for the vibration system consisting of the amplitude transformer 15 and the atomizing disk 16 is from 1/10 to 9/10 of the quarter vibration-wavelength $\lambda/4$. The length L in the embodiment shown is 16 mm. The amplitude transformer 15 in that embodiment has a diameter $D_A$ of 6 mm. The total diameter $D_Z$ of the atomizing disk 16 is 12 mm. At the transition 20 from the liquid bore 14 into the surface 17 of the atomizing disk 16, a comparitively large transition radius is also provided. Based on an illustrative diameter d of the liquid feed bore 14, the transmission radius 20 may be for instance 1.5 mm, whereby a final diameter of 5 mm may result in the liquid bore 14 on the surface 17 of the atomizing disk 16.

We claim:

1. An ultrasonic liquid atomizer, comprising:

(a) piezoelectric transducer means having a preselected resonant frequency;

(b) amplitude transformer means having a first end coupled to said transducer means and a second end remote therefrom and a generally tubular portion extending between said ends;

(c) said second end includes a flexural atomizing disk;

(d) said transformer means having a length of at least 1/10 to at most 9/10 of the wavelength of oscillation of said atomizing disk;

(e) said transformer means and said atomizing disk providing an oscillation system having a resonant frequency substantially equal to the resonant frequency of said transducer means;

(f) each of said ends has a diameter exceeding the diameter of said tubular portion;

(g) external transition sections of large radius extend between said ends and said tubular portion for providing low notch-stress for said system;

(h) liquid feed means communicate with said transducer means; and, (i) a central bore disposed in said transformer means extends between said ends and communicates with said liquid feed means for permitting liquid to flow from said feed means to said atomizing disk.

2. The atomizer as defined in claim 1, wherein:

(a) said transducer means resonant frequency is 60 kHz.

3. The atomizer as defined in claim 2, wherein:

(a) said tubular portion has a diameter of 6 mm and said atomizing disk has a diameter of 12 mm;

(b) said atomizing disk having a thickness of substantially 1 mm;

(c) said system having a length of substantially 16 mm; and, (d) said transition section between said first end and said tubular portion being substantially 2 mm and said transition section between said second end and said tubular portion being substantially 1.5 mm.

4. The atomizer as defined in claim 2, wherein:

(a) said central bore having an inner transition section of large radius merging into said atomizing disk; and, (b) said transition section between said second end and said tubular portion having a radius matched to the radius of said inner section so that said transformer means merges into said atomizing disk with constantly decreasing cross-section.

5. The atomizer as defined in claim 1, wherein:

(a) said liquid feed means being generally transverse to the longitudinal axis of said bore.

6. The atomizer as defined in claim 5, and wherein said transducer means includes:

(a) first and second spaced parallel ceramic disks; and, (b) electrode means disposed between and in engagement with said disks.

7. An ultrasonic liquid atomizer, comprising:

(a) piezoelectric transducer means having a preselected resonant frequency;

(b) amplitude transformer means extending from said transducer means and having a first end coupled thereto and a second end including a flexural atomizing disk remote therefrom and with an integral tubular portion extending between said ends;

(c) liquid feed means associated with said transducer means for supplying a liquid to be atomized;

(d) a central longitudinally extending bore in said transformer means communicating with said liquid feed means for permitting liquid to flow to said atomizing disk;

(e) said transformer means having a length which is not an integral multiple of the wavelength of oscillation of said atomizing disk;

(f) said transformer means and said atomizing disk comprise an oscillation system having a resonant frequency substantially equal to the resonant frequency of said transducer means;

(g) each of said ends has a diameter exceeding the diameter of said tubular portion; and, (h) external transition sections having a large radius of curvature merge said ends into said tubular portion so that said system has low notch-stress and said atomizing disk may flex.

8. The atomizer as defined in claim 7, wherein:

(a) said transformer means having a length of at least 1/10 to at most 9/10 of the wavelength of oscillation of said atomizing disk.

9. The atomizer as defined in claim 7, wherein:

(a) said central bore having an internal transition section of large radius merging into said atomizing disk; and, (b) said transition section between said second end and said tubular portion has a radius of curvature matched to and cooperating with the radius of curvature of said inner section so that said transformer means merges into said atomizing disk with constantly decreasing cross-section.

10. The atomizer as defined in claim 7, wherein:

(a) said piezoelectric transducer means resonant frequency is substantially 60 kHz.

11. The atomizer as defined in claim 7, wherein:

(a) said liquid feed means being generally transverse to the longitudinal axis of said bore.

* * * * *